US008393173B2

(12) United States Patent
Choi et al.

(10) Patent No.: US 8,393,173 B2
(45) Date of Patent: Mar. 12, 2013

(54) COMBINED REFRIGERATING/FREEZING AND AIR CONDITIONING SYSTEM

(75) Inventors: Jae Heuk Choi, Seoul (KR); Tae Hee Kwak, Seoul (KR); Yoon Ho Yoo, Seoul (KR); Do Yong Ha, Seoul (KR); Baik Young Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 407 days.

(21) Appl. No.: 12/727,382

(22) Filed: Mar. 19, 2010

(65) Prior Publication Data

US 2011/0120168 A1 May 26, 2011

(30) Foreign Application Priority Data

Nov. 20, 2009 (KR) ..... 10-2009-0112898

(51) Int. Cl.
*F25B 13/00* (2006.01)

(52) U.S. Cl. ..... 62/324.1; 62/498

(58) Field of Classification Search ..... 62/324.6, 62/498, 513, 335, 510
See application file for complete search history.

(56) References Cited

U.S. PATENT DOCUMENTS

| | | | | |
|---|---|---|---|---|
| 3,866,433 | A * | 2/1975 | Krug | 62/229 |
| 4,157,017 | A * | 6/1979 | Reid | 62/135 |
| 4,483,151 | A * | 11/1984 | Fujioka et al. | 62/157 |
| 4,565,072 | A * | 1/1986 | Fujiwara et al. | 62/196.2 |
| 4,637,222 | A * | 1/1987 | Fujiwara et al. | 62/244 |
| 4,748,823 | A * | 6/1988 | Asano et al. | 62/239 |
| 4,815,527 | A * | 3/1989 | Meckler | 165/50 |
| 5,787,719 | A * | 8/1998 | Wilson | 62/236 |
| 6,249,726 | B1 * | 6/2001 | Burke et al. | 701/31.6 |
| 6,405,554 | B1 * | 6/2002 | Kawakatu et al. | 62/335 |
| 6,557,361 | B1 * | 5/2003 | Howard | 62/175 |
| 6,595,009 | B1 * | 7/2003 | Howard et al. | 62/79 |
| 6,860,116 | B2 * | 3/2005 | Lifson et al. | 62/498 |
| 7,752,857 | B2 * | 7/2010 | Wakamoto et al. | 62/175 |
| 7,861,540 | B2 * | 1/2011 | Cloutier et al. | 62/63 |
| 7,984,621 | B2 * | 7/2011 | Park | 62/333 |
| 2008/0245505 | A1 * | 10/2008 | Yamaguchi et al. | 165/63 |
| 2009/0188272 | A1 * | 7/2009 | Cloutier et al. | 62/378 |

FOREIGN PATENT DOCUMENTS

| | | |
|---|---|---|
| CH | 225743 | 2/1943 |
| EP | 1 939 548 | 7/2008 |
| JP | 2003-283500 | 10/2003 |

(Continued)

OTHER PUBLICATIONS

Translation of JP 2006-189237 to Yamashita Koji et al.*

(Continued)

*Primary Examiner* — Mohammad Ali
(74) *Attorney, Agent, or Firm* — KED & Associates, LLP

(57) ABSTRACT

A combined refrigerating/freezing and air conditioning system is provided. The system may include an air conditioning circuit, a refrigerating circuit, a freezing circuit, a first heat exchanger, and a second heat exchanger. The air conditioning circuit may include a compressor, an outdoor heat exchanger, and an indoor heat exchanger. The refrigerating circuit may include compressor, a condenser, and an evaporator. The freezing circuit may include a compressor, a condenser, and an evaporator. The refrigerant of the air conditioning circuit may be heat-exchanged with the refrigerant of the refrigerating circuit in the first heat exchanger, and the refrigerant of the refrigerating circuit may be heat-exchanged with the refrigerant of the freezing circuit in the second heat exchanger to improve air conditioning efficiency and refrigerating/freezing efficiency of the system.

24 Claims, 5 Drawing Sheets

FOREIGN PATENT DOCUMENTS

| | | |
|---|---|---|
| JP | 2004-360999 | 12/2004 |
| JP | 2006-038293 | 2/2006 |
| JP | 2006-189237 | 7/2006 |
| JP | 2007-240040 | 9/2007 |
| JP | 2009-14271 | 1/2009 |

OTHER PUBLICATIONS

European Extended Search Report issued in EP Appln. No. EP 10157872.2 dated Jul. 4, 2011.

* cited by examiner

COMBINED REFRIGERATING/FREEZING AND AIR CONDITIONING SYSTEM

This claims priority to Korean Patent Application No. 10-2009-0112898, filed in Korea on Nov. 20, 2009, the entirety of which is incorporated herein by reference.

BACKGROUND

1. Field

This relates to an air conditioning system, and more particularly, to a combined refrigerating and freezing system that heats and cools an indoor space and that refrigerates and freezes an object.

2. Background

An air conditioning system performs heat exchange between a refrigerant flowing through a heat exchange cycle and indoor air and/or outdoor air to heat and cool a prescribed space.

DETAILED DESCRIPTION OF THE EMBODIMENTS

Reference will now be made in detail to embodiments, examples of which are illustrated in the accompanying drawings. Wherever possible, the same reference numbers will be used throughout the drawings to refer to the same or like parts.

Figure 1:
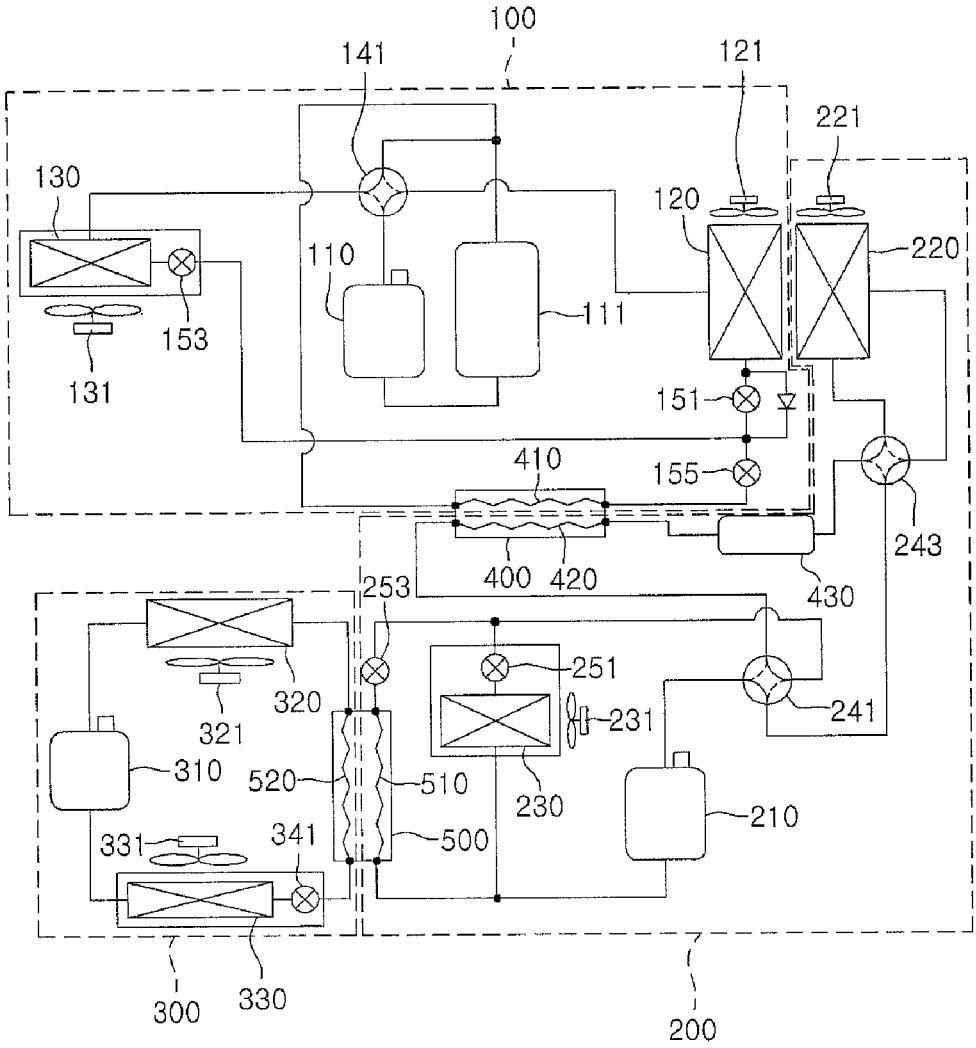
FIG. 1 is a schematic view of a combined refrigerating/freezing and air conditioning system according to an embodiment as broadly described herein.

Referring to FIG. 1, a combined refrigerating/freezing and air conditioning system as embodied and broadly described herein may include an air conditioning circuit 100, a refrigerating circuit 200, and a freezing circuit 300. The air conditioning circuit 100 conditions air in a prescribed indoor space, that is, heats or cools the prescribed indoor space. The refrigerating circuit 200 and the freezing circuit 300 supply cool air for refrigerating or freezing storage items, such as, for example, perishable food items.

More particularly, the air conditioning circuit 100 may include an air conditioning compressor 110 that compresses refrigerant flowing in the air conditioning circuit 100. An accumulator 111 may be positioned at inlet side of the air conditioning compressor 110 to separate liquid refrigerant from the refrigerant drawn into the air conditioning compressor 110.

The air conditioning circuit 100 may include an outdoor heat exchanger 120 and an indoor heat exchanger 130. The refrigerant is heat-exchanged with outdoor air at the outdoor heat exchanger 120. The refrigerant is heat-exchanged with indoor air at the indoor heat exchanger 130. The outdoor heat exchanger 120 and the indoor heat exchanger 130 may respectively function as a condenser and an evaporator in a cooling mode, and may respectively function as an evaporator and a condenser in a heating mode.

The air conditioning circuit 100 may also include first and second blowing fans 121 and 131 that respectively move outdoor air and indoor air heat-exchanged with the refrigerant flowing in the outdoor heat exchanger 120 and the indoor heat exchanger 130.

The air conditioning circuit 100 may also include a first four-way valve 141 that delivers the refrigerant compressed in the air conditioning compressor 110 to the outdoor heat exchanger 120 or the indoor heat exchanger 130 based on whether the air conditioner is in the cooling or heating mode. More particularly, in the cooling mode, the first four-way valve 141 is switched to deliver the refrigerant compressed in the air conditioning compressor 110 to the outdoor heat exchanger 120. In the heating mode, the first four-way valve 141 is switched to deliver the refrigerant compressed in the air conditioning compressor 110 to the indoor heat exchanger 130.

The air conditioning circuit 100 may also include first, second and third expansion valves 151, 153, and 155. The first and second expansion valves 151 and 153 are adjacent to the outdoor heat exchanger 120 and the indoor heat exchanger 130 on a refrigerant pipe connecting the outdoor heat exchanger 120 and the indoor heat exchanger 130. The third expansion valve 155 is disposed on a refrigerant pipe having one end connected to the refrigerant pipe connecting the outdoor heat exchanger 120 and the indoor heat exchanger 130 and another end connected to the inlet side of the air conditioning compressor 110 (substantially, to an inlet side of the accumulator 111). One end of the refrigerant pipe where the third expansion valve 155 is disposed is connected to the refrigerant pipe connecting the outdoor heat exchanger 120 and the indoor heat exchanger 130 between the first and second expansion valves 151 and 153.

The refrigerating circuit 200 may include a refrigerating compressor 210, a refrigerating condenser 220, and a refrigerating evaporator 230. The refrigerating compressor 210 compresses refrigerant flowing in the refrigerating circuit 200. The refrigerating condenser 220 heat-exchanges the refrigerant compressed in the refrigerating compressor 210 with air to condense the refrigerant. The refrigerating evaporator 230 heat-exchanges air with the refrigerant condensed in at least one of the refrigerating condenser 220 or a second cascade heat exchanger 500 that will be described later, so as to evaporate the refrigerant.

The refrigerating circuit 200 may also include third and fourth blowing fans 221 and 231 that blow air to the refrigerating condenser 220 and the refrigerating evaporator 230 to heat-exchange the air with the refrigerant flowing in the refrigerating condenser 220 and the refrigerating evaporator 230. Substantially, air blown to the refrigerating evaporator 230 by the fourth blowing fan 231 refrigerates storage items.

The refrigerating circuit 200 includes second and third four-way valves 241 and 243. The second four-way valve 241 is switched to vary, based on the modes of the air conditioning circuit 100, the flow direction/order of the refrigerant compressed in the refrigerating compressor 210 to the refrigerating condenser 220 and the first cascade heat exchanger 400. More particularly, when the air conditioning circuit 100 is in the cooling mode, the second four-way valve 241 is switched such that the refrigerant compressed in the refrigerating compressor 210 sequentially flows to the refrigerating condenser 220 and the first cascade heat exchanger 400. When the air conditioning circuit 100 is in the heating mode, the second four-way valve 241 is switched such that the refrigerant compressed in the refrigerating compressor 210 sequentially flows to the first cascade heat exchanger 400 and the refrigerating condenser 220. The third four-way valve 243 selectively delivers the refrigerant compressed in the refrigerating compressor 210 to the refrigerating condenser 220 based on a condition of outdoor air. More particularly, when the temperature of outdoor air is significantly low, the third four-way valve 243 delivers the refrigerant compressed in the refrigerating compressor 210 to the first cascade heat exchanger 400 without delivering the refrigerant to the refrigerating condenser 220.

The refrigerating circuit 200 may also include fourth and fifth expansion valves 251 and 253. The fourth expansion valve 251 is disposed on a refrigerant pipe on an inlet side of the refrigerating evaporator 230. The fifth expansion valve 253 is disposed on a refrigerant pipe having its respective ends connected to refrigerant pipes on inlet and outlet sides of the refrigerating evaporator 230. Openings of the fourth and fifth expansion valves 251 and 253 may be adjusted to control the amount of the refrigerant introduced to the second cascade heat exchanger 500.

The freezing circuit 300 may include a freezing compressor 310, a freezing condenser 320, and a freezing evaporator 330. The freezing compressor 310 compresses refrigerant circulating in the freezing circuit 300. The freezing condenser 320 heat-exchanges outdoor air with the refrigerant compressed in the freezing compressor 310 to condense the refrigerant. The freezing evaporator 330 heat-exchanges indoor air with the refrigerant condensed in the freezing condenser 320 to evaporate the refrigerant.

The freezing circuit 300 may also fifth and sixth blowing fans 321 and 331 that respectively blow air to the freezing condenser 320 and the freezing evaporator 330. Air, blown to the freezing evaporator 330 and heat-exchanged with the refrigerant flowing in the freezing evaporator 330 by the sixth blowing fan 331, freezes storage items. The freezing circuit 300 may also include a sixth expansion valve 341 that is at a refrigerant pipe disposed on an inlet side of the freezing evaporator 330.

In this embodiment, the first cascade heat exchanger 400 is positioned between the air conditioning circuit 100 and the refrigerating circuit 200, and the second cascade heat exchanger 500 is positioned between the refrigerating circuit 200 and the freezing circuit 300. The first and second cascade heat exchangers 400 and 500 transmit heat from the refrigerating circuit 200 or the freezing circuit 300 having a relatively low coefficient of performance (COP) to the air conditioning circuit 100 or the refrigerating circuit 200 having a relatively high COP, so as to increase the efficiency of all of the air conditioning circuit 100, the refrigerating circuit 200, and the freezing circuit 300 and decrease power consumption accordingly.

The first cascade heat exchanger 400 may include first and second passages 410 and 420 through which refrigerant flows, and the second cascade heat exchanger 500 may include first and second passages 510 and 520 through which refrigerant flows. The heat transfer of the refrigerant flowing in the first and second passages 410, 420, 510, and 520 may be performed by a heat transfer member (not shown).

The first cascade heat exchanger 400 heat-exchanges the refrigerant of the air conditioning circuit 100 with the refrigerant of the refrigerating circuit 200. The refrigerant of the air conditioning circuit 100 heat-exchanged in the first cascade heat exchanger 400 has a lower pressure than that of the refrigerant of the refrigerating circuit 200. Thus, the refrigerant of the air conditioning circuit 100 having the lower pressure is evaporated through the heat exchange in the first cascade heat exchanger 400, and the refrigerant of the refrigerating circuit 200 having the higher pressure is condensed through the heat exchange in the first cascade heat exchanger 400. As such, the refrigerant of the refrigerating circuit 200 is condensed through the heat exchange in the first cascade heat exchanger 400, so that heat is transferred from the refrigerating circuit 200 (having a relatively low COP) to the air conditioning circuit 100 (having a relatively high COP). To this end, the refrigerant circulating through the air conditioning circuit 100 and the refrigerant circulating through the refrigerating circuit 200 respectively flow in the first and second passages 410 and 420 of the first cascade heat exchanger 400, and are heat-exchanged with each other through a heat exchange member of the first cascade heat exchanger 400.

The second cascade heat exchanger 500 heat-exchanges the refrigerant of the refrigerating circuit 200 with the refrigerant of the freezing circuit 300. The refrigerant of the refrigerating circuit 200 heat-exchanged in the second cascade heat exchanger 500 has a lower pressure than that of the refrigerant of the freezing circuit 300. Thus, the refrigerant of the refrigerating circuit 200 having the lower pressure is evaporated through the heat exchange in the second cascade heat exchanger 500, and the refrigerant of the freezing circuit 300 having the higher pressure is condensed through the heat exchange in the second cascade heat exchanger 500. As such, the refrigerant of the freezing circuit 300 is condensed, so that heat is transferred to the refrigerating circuit 200 (having a relatively high COP) from the freezing circuit 300 (having a relatively low COP). To this end, the refrigerant circulating through the refrigerating circuit 200 and the refrigerant circulating through the freezing circuit 300 respectively flow in the first and second passages 510 and 520 of the second cascade heat exchanger 500, and are heat-exchanged with each other through a heat exchange member of the second cascade heat exchanger 500.

In certain embodiments, the refrigerant of the refrigerating circuit 200 passing through the first cascade heat exchanger 400 may be stored in liquid state in a liquid receiver 430 before passing through the fourth and fifth expansion valves 251 and 253.

Figure 2:
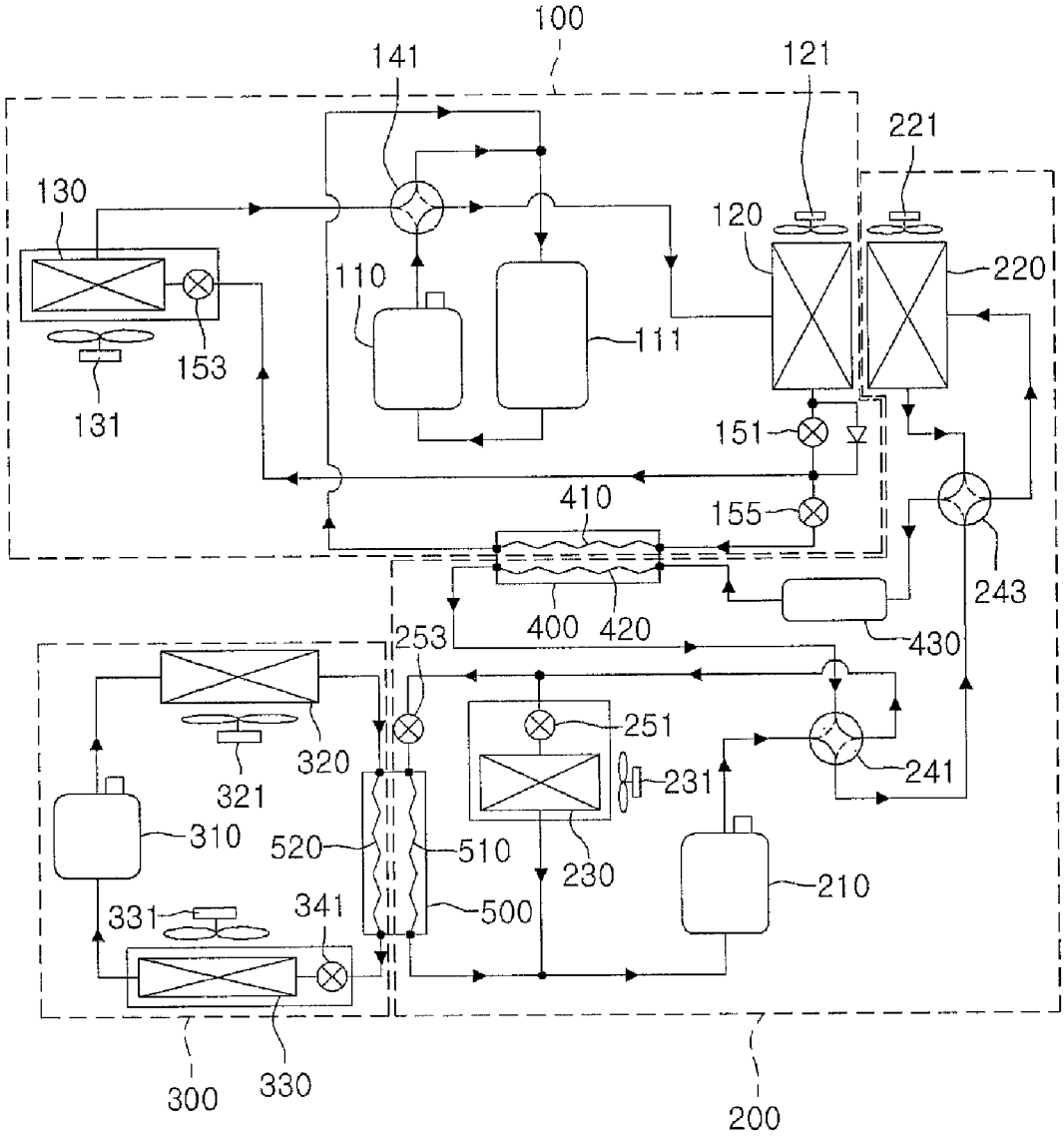
FIG. 2 is a schematic view of a flow of refrigerant in a cooling and refrigerating/freezing mode in the system shown in FIG. 1.

An air conditioning and refrigerating/freezing mode will now be described according to the current embodiment with reference to FIG. 2. In the cooling mode of the air conditioning circuit 100, the refrigerant compressed in the air conditioning compressor 110 is delivered to the outdoor heat exchanger 120 by the first four-way valve 141. The refrigerant delivered to the outdoor heat exchanger 120 is heat-exchanged with outdoor air and condensed by the first blowing fan 121.

The refrigerant condensed in the outdoor heat exchanger 120 is expanded by the second expansion valve 153 and delivered to the indoor heat exchanger 130. The refrigerant delivered to the indoor heat exchanger 130 is heat-exchanged with indoor air flowing to the indoor heat exchanger 130 and evaporated by the second blowing fan 131. The heat-exchanged indoor air is delivered to the indoor space, so that the indoor space is cooled. The refrigerant evaporated in the indoor heat exchanger 130 is delivered to the air conditioning compressor 110.

A portion of the refrigerant condensed at the outdoor heat exchanger 120 may flow to the first passage 410 of the first cascade heat exchanger 400. That is, low pressure refrigerant of the air conditioning circuit 100 expanded by the third expansion valve 155 may flow through the first passage 410 of the first cascade heat exchanger 400.

The refrigerant compressed in the refrigerating compressor 210 of the refrigerating circuit 200 is sequentially delivered to the refrigerating condenser 220 and the first cascade heat exchanger 400 by the second and third four-way valves 241 and 243. The refrigerant compressed in the refrigerating compressor 210 is delivered to the refrigerating condenser 220. The refrigerant delivered to the refrigerating condenser 220 is heat-exchanged with air flowing to the refrigerating condenser 220 and condensed by the third blowing fan 221.

The refrigerant condensed in the refrigerating condenser 220 may flow through the second passage 420 of the first cascade heat exchanger 400. The refrigerant of the air conditioning circuit 100 flowing through the first passage 410 of the first cascade heat exchanger 400 is heat-exchanged with the refrigerant of the refrigerating circuit 200 flowing through the second passage 420 of the first cascade heat exchanger 400. The refrigerant of the air conditioning circuit 100 flowing through the first passage 410 of the first cascade heat exchanger 400 a the lower pressure than that of the refrigerant of the refrigerating circuit 200 flowing through the second passage 420 of the first cascade heat exchanger 400. Thus, the refrigerant of the air conditioning circuit 100 is evaporated, and the refrigerant of the refrigerating circuit 200 is condensed.

The refrigerant of the refrigerating circuit 200 condensed through the first cascade heat exchanger 400 is delivered to the refrigerating evaporator 230 and heat-exchanged with air flowing to the refrigerating evaporator 230 and evaporated by the fourth blowing fan 231, and the heat-exchanged air performs a refrigerating operation. The refrigerant evaporated in the refrigerating evaporator 230 is delivered to the refrigerating compressor 210.

A portion of the refrigerant of the refrigerating circuit 200 condensed through the second passage 420 of the first cascade heat exchanger 400 may flow to the first passage 510 of the second cascade heat exchanger 500. At this point, the portion of the refrigerant of the refrigerating circuit 200 is expanded by the fifth expansion valve 253.

The refrigerant compressed in the freezing compressor 310 of the freezing circuit 300 flows to the freezing condenser 320. The refrigerant flowing to the freezing condenser 320 is condensed by air blown to the freezing condenser 320 by the fifth blowing fan 321.

The refrigerant condensed in the freezing condenser 320 flows through the second passage 520 of the second cascade heat exchanger 500. The refrigerant of the refrigerating circuit 200 is heat-exchanged with the refrigerant of the freezing circuit 300 by the second cascade heat exchanger 500. As described above, since the refrigerant of the refrigerating circuit 200 flowing through the first passage 510 of the second cascade heat exchanger 500 is expanded by the fifth expansion valve 253, the refrigerant of the refrigerating circuit 200 a the lower pressure than that of the refrigerant of the freezing circuit 300 flowing through the second passage 520 of the second cascade heat exchanger 500. Thus, the refrigerant of the refrigerating circuit 200 is evaporated, and the refrigerant of the freezing circuit 300 is condensed.

The refrigerant of the freezing circuit 300 condensed through the second passage 520 of the second cascade heat exchanger 500 is delivered to the freezing evaporator 330 and heat-exchanged with air flowing to the freezing evaporator 330 and evaporated by the sixth blowing fan 331, and the heat-exchanged air performs a freezing operation.

Figure 3:
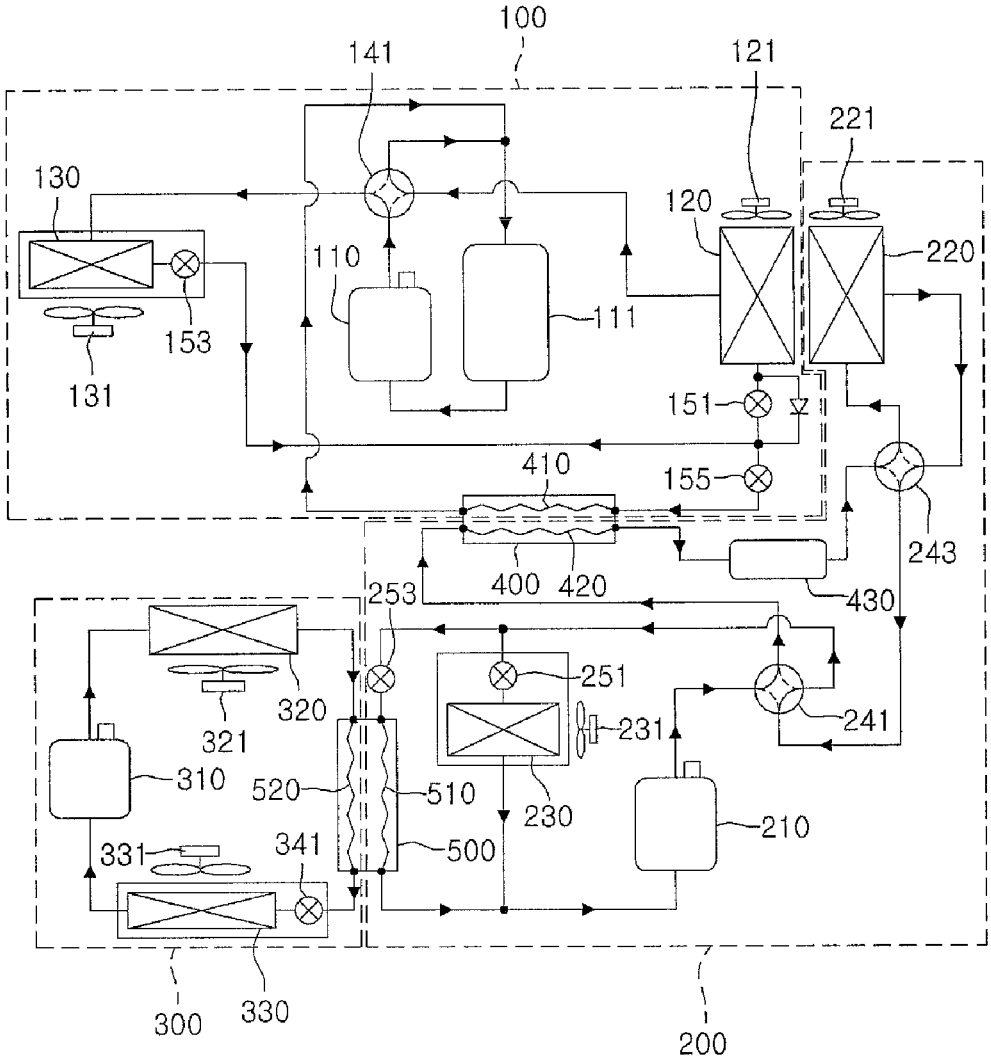
FIG. 3 is a schematic view of a flow of refrigerant in a heating and refrigerating/freezing mode in the system shown in FIG. 1.

Hereinafter, a heating and refrigerating/freezing mode will now be described with reference to FIG. 3. In the heating mode of the air conditioning circuit 100, the refrigerant compressed in the air conditioning compressor 110 is delivered to the indoor heat exchanger 130 by the first four-way valve 141, is heat-exchanged with indoor air, and is condensed by the second blowing fan 131. The heat-exchanged indoor air heats the indoor space.

The refrigerant condensed in the indoor heat exchanger 130 is expanded by the first expansion valve 151 and delivered to the outdoor heat exchanger 120, where it is heat-exchanged with outdoor air blown by the first blowing fan 121, and evaporated. The refrigerant evaporated through the outdoor heat exchanger 120 is delivered to the air conditioning compressor 110.

A portion of the refrigerant condensed at the indoor heat exchanger 130 flows to the first passage 410 of the first cascade heat exchanger 400. At this point, low pressure refrigerant of the air conditioning circuit 100 expanded by the third expansion valve 155 flows through the first passage 410 of the first cascade heat exchanger 400.

The refrigerant compressed in the refrigerating compressor 210 of the refrigerating circuit 200 is sequentially delivered to the first cascade heat exchanger 400 and the refrigerating condenser 220 by the second and third four-way valves 241 and 243. Accordingly, the refrigerant of the refrigerating circuit 200 is efficiently condensed although the outdoor air has a lower temperature than that of the refrigerant in the heating mode. More particularly, since the heating mode is performed when the outdoor temperature is low, the refrigerant of the air conditioning circuit 100 (having a higher temperature than that of the outdoor air) is condensed in the first cascade heat exchanger 400 and condensed again in the refrigerating condenser 220, so as to improve the condensation efficiency of the refrigerant of the refrigerating circuit 200.

The refrigerant compressed in the refrigerating compressor 210 flows through the second passage 420 of the first cascade heat exchanger 400. As described above, the refrigerant of the air conditioning circuit 100 flowing through the first passage 410 of the first cascade heat exchanger 400 has a lower pressure than that of the refrigerant of the refrigerating circuit 200 flowing through the second passage 420 of the first cascade heat exchanger 400. Thus, the refrigerant of the air conditioning circuit 100 flowing through the first passage 410 of the first cascade heat exchanger 400 is evaporated, and the refrigerant of the refrigerating circuit 200 flowing through the second passage 420 of the first cascade heat exchanger 400 is condensed.

The refrigerant condensed through the first cascade heat exchanger 400 is delivered to the refrigerating condenser 220, is heat-exchanged with air blown to the refrigerating condenser 220 by the third blowing fan 221, and is condensed.

The refrigerant condensed through the refrigerating condenser 220 is delivered to the refrigerating evaporator 230, is heat-exchanged with air blown to the refrigerating evaporator 230 by the fourth blowing fan 231, and is evaporated. The heat-exchanged air performs a refrigerating operation. The refrigerant evaporated in the refrigerating evaporator 230 is delivered to the refrigerating compressor 210.

A portion of the refrigerant of the refrigerating circuit 200 condensed through the second passage 420 of the first cascade heat exchanger 400 flows to the first passage 510 of the second cascade heat exchanger 500. At this point, the portion of the refrigerant of the refrigerating circuit 200 is expanded by the fifth expansion valve 253.

The flow of the refrigerant of the freezing circuit 300, and the heat exchange between the refrigerating circuit 200 and the freezing circuit 300 in the second cascade heat exchanger 500 are substantially the same as those in the cooling and refrigerating/freezing mode as described above. Thus, a detailed description thereof will be omitted.

Figure 4:
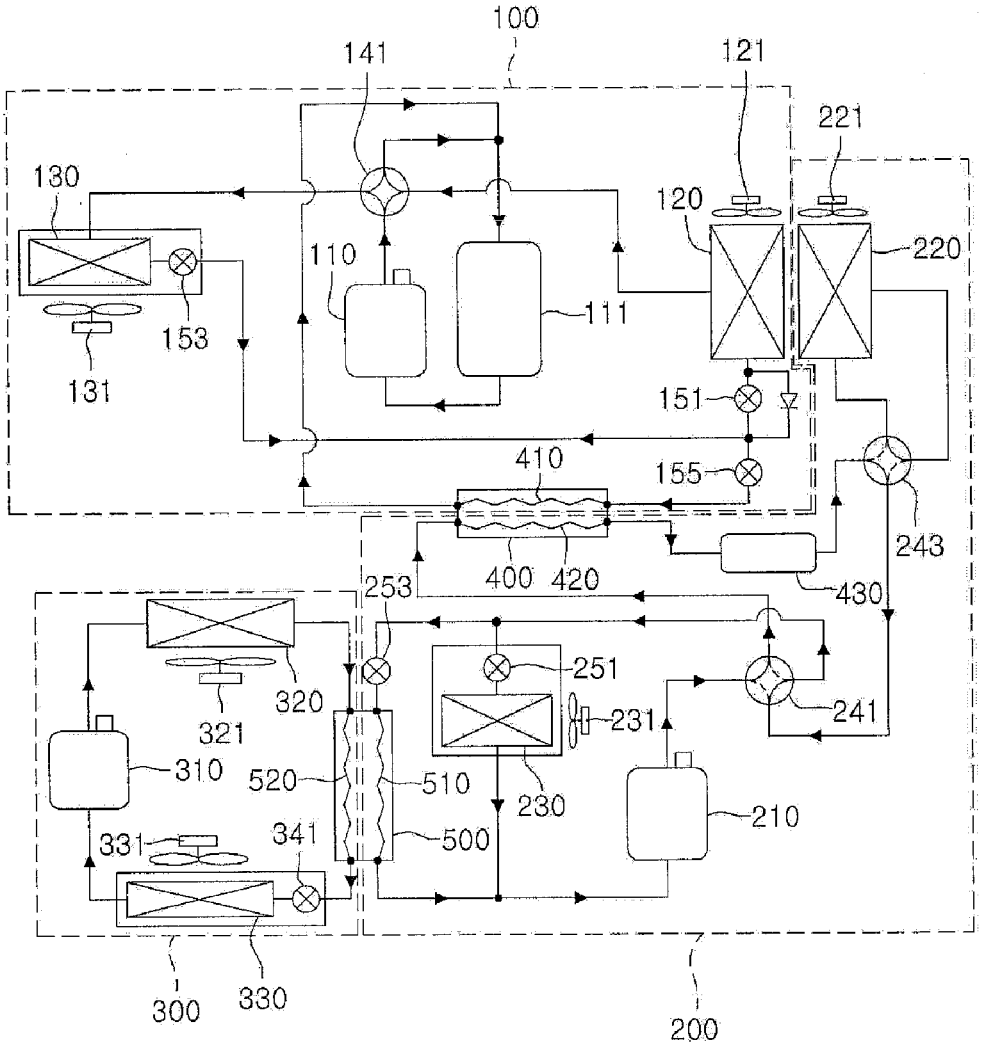
FIG. 4 is a schematic view of a flow of refrigerant in a heating and refrigerating/freezing mode under severe cold conditions in the system shown in FIG. 1.

Hereinafter, a heating and refrigerating/freezing mode under a severe cold condition will now be described with reference to FIG. 4. The flow of refrigerant of the air conditioning circuit 100 and the freezing circuit 300 in the heating and refrigerating/freezing mode under a severe cold condition is substantially the same as that in the aforementioned heating and refrigerating/freezing mode. Thus, a detailed description thereof will be omitted.

The second and third four-way valves 241 and 243 of the refrigerating circuit 200 may be switched to deliver the refrigerant compressed in the refrigerating compressor 210 to the first cascade heat exchanger 400 without delivering the refrigerant to the refrigerating condenser 220. In other words, the refrigerant compressed in the refrigerating compressor 210 flows through the first cascade heat exchanger 400 through the switching of the second four-way valve 241, and the refrigerant flowing through the first cascade heat exchanger 400 flows to the refrigerating evaporator 230 without flowing through the refrigerating condenser 220 due to the switching of the third four-way valve 243. Since the efficiency of the refrigerating condenser 220 may be degraded at significantly low outdoor temperatures, the refrigerant of the refrigerating circuit 200 flows only to the first cascade heat exchanger 400 without flowing through the refrigerating condenser 220. For example, in a defrosting condition, the second and third four-way valves 241 and 243 may deliver the refrigerant compressed in the refrigerating compressor 210 only to the first cascade heat exchanger 400 without delivering the refrigerant to the refrigerating condenser 220.

More particularly, the refrigerant compressed in the refrigerating compressor 210 flows through the second passage 420 of the first cascade heat exchanger 400. The refrigerant of the refrigerating circuit 200 flowing through the second passage 420 of the first cascade heat exchanger 400 has a higher pressure than that of the refrigerant of the air conditioning circuit 100 flowing through the first passage 410 of the first cascade heat exchanger 400. Thus, the refrigerant of the refrigerating circuit 200 flowing through the second passage 420 of the first cascade heat exchanger 400 is heat-exchanged with the refrigerant of the air conditioning circuit 100 flowing through the first passage 410 of the first cascade heat exchanger 400, and is condensed.

The refrigerant of the refrigerating circuit 200 condensed through the first cascade heat exchanger 400 is delivered to the refrigerating evaporator 230, is heat-exchanged with air blown to the refrigerating evaporator 230 by the fourth blowing fans 231, and is evaporated. A portion of the refrigerant of the refrigerating circuit 200 condensed in the first cascade heat exchanger 400 is expanded by the fourth expansion valves 251, is heat-exchanged with the refrigerant of the freezing circuit 300 through the second cascade heat exchanger 500, and is evaporated. This is substantially the same as that of the aforementioned heating and refrigerating/freezing mode, and thus, a detailed description thereof will be omitted.

Hereinafter, a combined refrigerating/freezing and air conditioning system in accordance with another embodiment will be described with reference to FIG. 5. Wherever possible, reference numerals of the embodiment shown in FIGS. 1 to 4 are used for the same part of the embodiment shown in FIG. 5, and a detailed description thereof will be omitted.

Figure 5:
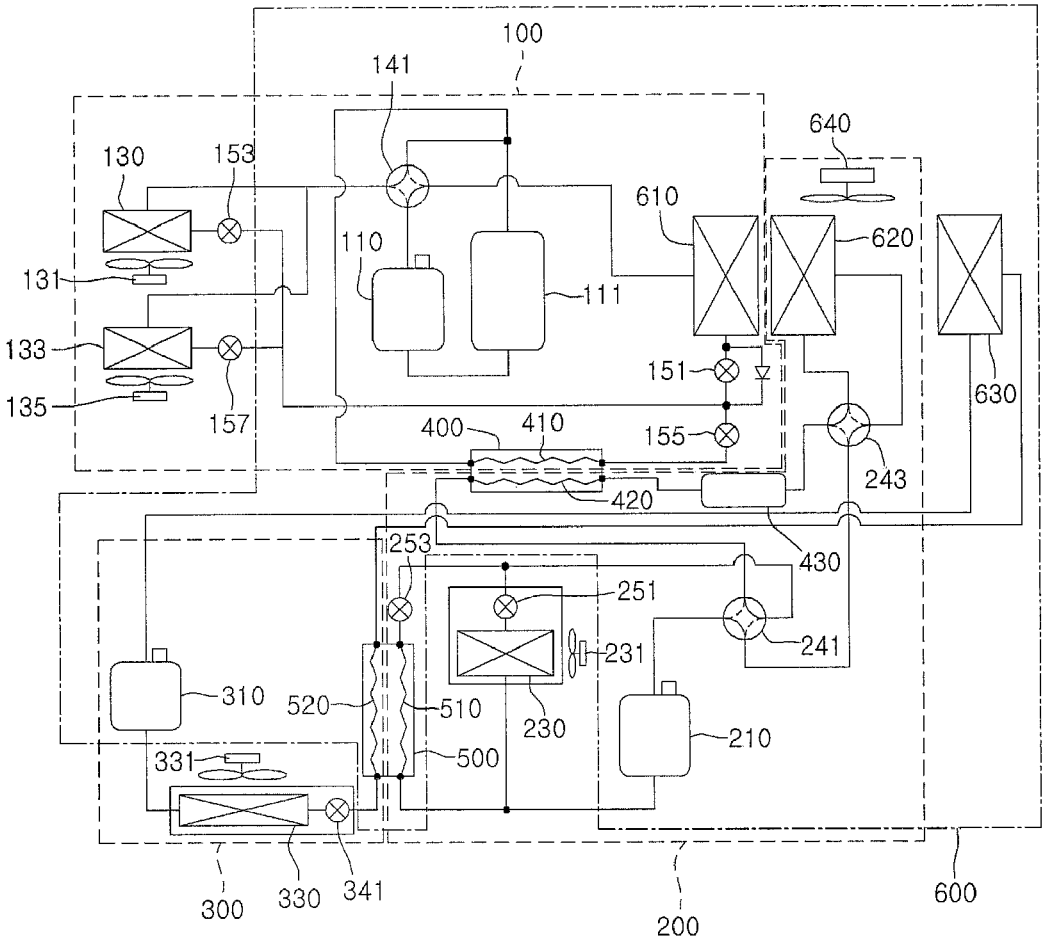
FIG. 5 is a schematic view of a combined refrigerating/freezing and air conditioning system according to another embodiment as broadly described herein.

In the embodiment shown in FIG. 5, an outdoor heat exchanger 610 of the air conditioning circuit 100, a refrigerating condenser 620 of the refrigerating circuit 200, and a freezing condenser 630 of the freezing circuit 300 may all be installed in a single unit, that is, in a single outdoor unit 600. Additionally, air flows for condensing the refrigerant in the outdoor heat exchanger 120 and the refrigerating condenser 220 of the previous embodiment may be generated by a single blowing fan 640 in the current embodiment. That is, two of the first blowing fan 121, the third blowing fan 221, and the fifth blowing fan 321 of the previous embodiment ma be eliminated.

In the embodiment shown in FIG. 5, aside from the indoor heat exchanger 130, the air conditioning circuit 100 may also include an indoor heat exchanger 133. Thus, air conditioning operations may be independently performed on a plurality of indoor spaces separated from each other.

In a system as embodied and broadly described herein, the air conditioning efficiency of an indoor space and the refrigerating/freezing efficiency of an object may be improved.

In addition, heat transfer between the air conditioning circuit and the refrigerating circuit, and between the refrigerating circuit and the freezing circuit may be performed to improve the air conditioning efficiency of an indoor space and the refrigerating/freezing efficiency of an object.

A combined refrigerating/freezing and air conditioning system is provided that heats and cools an indoor space and that refrigerates and freezes an object.

A refrigerating/freezing and air conditioning system as embodied and broadly described herein may include an air conditioning circuit including an air conditioning compressor, an outdoor heat exchanger, and an indoor heat exchanger where refrigerant for conditioning air circulates; a refrigerating circuit including a refrigerating compressor, a refrigerating condenser, and a refrigerating evaporator where refrigerant for refrigerating circulates; a freezing circuit including a freezing compressor, a freezing condenser, and a freezing evaporator where refrigerant for freezing circulates; a first heat exchanging unit where the low pressure refrigerant of the air conditioning circuit is heat-exchanged with the high pressure refrigerant of the refrigerating circuit; and a second heat exchanging unit where the low pressure refrigerant of the refrigerating circuit is heat-exchanged with the high pressure refrigerant of the freezing circuit.

In another embodiment, a combined refrigerating/freezing and air conditioning system as broadly described herein may include an air conditioning circuit including parts that constitute a heat exchange cycle through which a first refrigerant for conditioning air circulates; a refrigerating circuit including parts that constitute a heat exchange cycle through which a second refrigerant for refrigerating circulates; a freezing circuit including parts that constitute a heat exchange cycle through which a third refrigerant for freezing circulates; a first cascade heat exchanger where the first refrigerant is evaporated and the second refrigerant is condensed through heat exchange between the first and second refrigerants; and a second cascade heat exchanger where the second refrigerant is evaporated and the third refrigerant is condensed through heat exchange between the second and third refrigerants.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A combined refrigerating/freezing and air conditioning system, comprising:

an air conditioning circuit including an air conditioning compressor, an outdoor heat exchanger, and an indoor heat exchanger;

a refrigerating circuit including a refrigerating compressor, a refrigerating condenser, and a refrigerating evaporator;

a freezing circuit including a freezing compressor, a freezing condenser, in the freezing compressor a refrigerant compressed and the freezing compressor is heat-exchanged with outdoor air, and a freezing evaporator;

a first heat exchanger performing heat exchange between refrigerant flowing through the air conditioning circuit and refrigerant flowing through the refrigerating circuit; and a second heat exchanger performing heat exchange between refrigerant flowing through the refrigerating circuit and refrigerant flowing through the freezing condenser in the freezing circuit.

2. The system of claim 1, wherein refrigerant flowing through the refrigerating circuit is condensed in the refrigerating condenser, and then heat-exchanged with refrigerant flowing through the air conditioning circuit.

3. The system of claim 1, wherein refrigerant flowing through the refrigerating circuit is heat-exchanged with refrigerant flowing through the air conditioning circuit, and then condensed in the refrigerating condenser.

4. The system of claim 1, wherein the air conditioning circuit has a cooling mode and a heating mode, and wherein refrigerant flowing through the refrigerating circuit is condensed in the refrigerating condenser, and then heat-exchanged with refrigerant flowing through the air conditioning circuit in the cooling mode, and refrigerant flowing through the refrigerating circuit is heat-exchanged with refrigerant flowing through the air conditioning circuit and is then condensed in the refrigerating condenser in the heating mode.

5. The system of claim 1, wherein an order of performing one operation in which refrigerant flowing through the refrigerating circuit is condensed in the refrigerating condenser and another operation in which refrigerant flowing through the refrigerating circuit is heat-exchanged with refrigerant flowing the air conditioning circuit is determined based on outdoor air conditions.

6. The system of claim 1, further comprising a switch controlling flow of refrigerant through a passage connecting the refrigerating compressor, the refrigerating condenser and the first heat exchanger.

7. The system of claim 6, wherein the switch directs refrigerant that has been compressed in the refrigerating compressor to at least one of the refrigerating condenser or the first heat exchanger.

8. The system of claim 1, further comprising:

a first switch directing a flow of refrigerant compressed in the refrigerating compressor to the refrigerating condenser or to the second heat exchanger; and a second switch directing a flow of refrigerant condensed in the refrigerating condenser to the second heat exchanger or to the refrigerating evaporator.

9. The system of claim 8, wherein the air conditioning circuit has a cooling mode and a heating mode, and wherein, in the cooling mode, refrigerant compressed in the refrigerating compressor is directed to the refrigerating condenser by the first switch and condensed, and is then directed to the first heat exchanger by the second switch, and in the heating mode, refrigerant compressed in the refrigerating compressor is directed to the first heat exchanger by the first switch and heat-exchanged with refrigerant flowing through the air conditioning circuit, and is then directed to the refrigerating condenser by the second switch.

10. The system of claim 8, wherein refrigerant compressed in the refrigerating compressor is directed to the second heat exchanger by the first switch and heat-exchanged with refrigerant flowing through the air conditioning circuit, and is then directed to the refrigerating condenser by the second switch based on outdoor air conditions.

11. A combined refrigerating/freezing and air conditioning system, comprising:

an air conditioning circuit through which a first refrigerant circulates so as to perform an air conditioning cycle;

a refrigerating circuit through which a second refrigerant circulates so as to perform a refrigerating cycle;

a freezing circuit through which a third refrigerant circulates so as to perform a freezing cycle;

a first heat exchanger selectively performing heat exchange between the first refrigerant and the second refrigerant;

a second heat exchanger selectively performing heat exchange between the second refrigerant and the third refrigerant and a four-way valve directing the second refrigerant of the refrigerating circuit to the first heat exchanger after being condensed in the refrigerating circuit, or after being compressed in the refrigerating circuit and before being condensed in the refrigerating circuit.

12. The system of claim 11, wherein the second heat exchanger comprises a cascade heat exchanger transferring heat from the third refrigerant flowing through the freezing circuit to the second refrigerant flowing through the refrigerating circuit.

13. The system of claim 12, wherein the first heat exchanger comprises a cascade heat exchanger transferring heat from the second refrigerant flowing through the refrigerating circuit to the first refrigerant flowing through the air conditioning circuit.

14. The system of claim 11, wherein the first refrigerant supplied to the first heat exchanger from the air conditioning circuit has a relatively low pressure and is heat-exchanged with the second refrigerant supplied to the first heat exchanger from the refrigerating circuit, the second refrigerant having a relatively high pressure.

15. The system of claim 11, wherein the second refrigerant supplied to the second heat exchanger from the refrigerating circuit has a relatively low pressure and is heat-exchanged with the third refrigerant supplied to the second heat exchanger from the freezing circuit, the third refrigerant having a relatively high pressure.

16. The system of claim 11, wherein the second refrigerant of the refrigerating circuit is heat-exchanged with the first refrigerant of the air conditioning circuit by the first heat exchanger after being condensed in the refrigerating circuit.

17. The system of claim 11, wherein the second refrigerant of the refrigerating circuit is heat-exchanged with the first refrigerant of the air conditioning circuit by the first heat exchanger after being compressed in the refrigerating circuit and before being condensed in the refrigerating circuit.

18. The system of claim 11, wherein the air conditioning circuit has a cooling mode and a heating mode, and wherein, when the air conditioning circuit is in the cooling mode, the second refrigerant of the refrigerating circuit is heat-exchanged with the first refrigerant of the air conditioning circuit by the first heat exchanger after being condensed in the refrigerating circuit, and when the air conditioning circuit is in the heating mode, the second refrigerant of the refrigerating circuit is heat-exchanged with the first refrigerant of the air conditioning circuit by the first heat exchanger after being compressed in the refrigerating circuit and before being condensed in the refrigerating circuit.

19. A combined refrigerating and air conditioning system, comprising:

an air conditioning circuit including an air conditioning compressor, an outdoor heat exchanger, and an indoor heat exchanger;

a refrigerating circuit including a refrigerating compressor, a refrigerating condenser, and a refrigerating evaporator; and a first heat exchanger performing heat exchange between refrigerant flowing through the air conditioning circuit and refrigerant flowing through the refrigerating circuit, wherein refrigerant of the refrigerating circuit is condensed in the refrigerating condenser and is then heat-exchanged with refrigerant of the air conditioning circuit in the first heat exchanger in a cooling mode of the air conditioning circuit, and wherein refrigerant of the refrigerating circuit is heat-exchanged with refrigerant of the air conditioning circuit in the first heat exchanger and is then condensed in the refrigerating condenser in a heating mode of the air conditioning circuit.

20. The system of claim 19, further comprising:

a freezing circuit including a freezing compressor, a freezing condenser and a freezing evaporator; and a second heat exchanger performing heat exchange between refrigerant flowing through the refrigerating circuit and refrigerant flowing through the freezing circuit.

21. The system of claim 19, wherein the outdoor heat exchanger and the refrigerating condenser are installed in a single outdoor unit.

22. The system of claim 21, wherein the freezing condenser is also installed in the single outdoor unit together with the outdoor heat exchanger and the refrigerating condenser.

23. The system of claim 20, wherein heat is transferred from the refrigerant of the refrigerating circuit to the refrigerant of the air conditioning circuit in the first heat exchanger, and heat is transferred from the refrigerant of the freezing circuit to the refrigerant of the refrigerating circuit in the second heat exchanger.

24. The system of claim 19, wherein an order of performing one operation in which refrigerant of the refrigerating circuit is condensed in the refrigerating condenser and another operation in which refrigerant of the refrigerating circuit is heat-exchanged with the refrigerant of the air conditioning circuit is determined based on outdoor air conditions.

* * * * *